US011035637B2

(12) United States Patent
Barney

(10) Patent No.: US 11,035,637 B2
(45) Date of Patent: Jun. 15, 2021

(54) FIREARM SUPPRESSOR

(71) Applicant: AMTAC, Inc., Salt Lake City, UT (US)

(72) Inventor: Anthony L. Barney, Salt Lake City, UT (US)

(73) Assignee: AEGIX GLOBAL, LLC, Salt Lake City, UT (US)

( * ) Notice: Subject to any disclaimer, the term of this patent is extended or adjusted under 35 U.S.C. 154(b) by 0 days.

(21) Appl. No.: 15/589,723

(22) Filed: May 8, 2017

(65) Prior Publication Data

US 2018/0321008 A1 Nov. 8, 2018

(51) Int. Cl.
*F41A 21/30* (2006.01)
*F41A 21/28* (2006.01)

(52) U.S. Cl.
CPC ..... *F41A 21/30* (2013.01); *F41A 21/28* (2013.01)

(58) Field of Classification Search
CPC ..... F41A 21/32–38; F41A 21/30
USPC ..... 89/14.2–14.4; 181/223
See application file for complete search history.

(56) References Cited

U.S. PATENT DOCUMENTS 916,885 A * 3/1909 Maxim ..... F41A 21/30 181/223
2,966,682 A * 1/1961 Henning ..... B25C 1/188 227/8
3,179,011 A * 4/1965 Rahm ..... F41A 21/36 89/14.3
3,298,280 A * 1/1967 Rahm ..... F41A 21/36 89/14.3
3,707,899 A * 1/1973 Perrine ..... F41A 21/36 89/14.3
3,786,895 A * 1/1974 Perrine ..... F01N 1/003 181/223
4,291,610 A * 9/1981 Waiser ..... F41A 21/30 89/14.4
4,588,043 A 5/1986 Finn
4,907,488 A 3/1990 Seberger
(Continued)

OTHER PUBLICATIONS alloutdoor.com, "Maintenance-Friendly Design With Asymmetric Baffle Stack." Gemtech GM22 Suppressor, Sep. 17, 2017; 9 Pages.

*Primary Examiner* — Stephen Johnson
*Assistant Examiner* — Benjamin S Gomberg
(74) *Attorney, Agent, or Firm* — Thorpe North & Western, LLP

(57) ABSTRACT

A firearm suppressor can comprise an outer shell, and a suppressor core disposed inside the outer shell. The suppressor core can have a projectile passageway for a projectile from a firearm to travel through. The projectile passageway can extend along a longitudinal axis. The suppressor core can also include a central support rib disposed along the longitudinal axis. In addition, the suppressor core can include a first baffle and a second baffle spaced apart along the longitudinal axis and supported by the central support rib. The first and second baffles can be oriented at different angles from one another. The first and second baffles and the central support rib can at least partially define the projectile passageway. The first and second baffles and the central support rib can also at least partially form two different sized expansion chambers on opposite sides of the central support rib in fluid communication with the projectile passageway to receive discharge gases associated with the projectile.

25 Claims, 10 Drawing Sheets

(56) References Cited

U.S. PATENT DOCUMENTS 4,974,489 A * 12/1990 Fishbaugh ..... F41A 21/30 89/14.4
D415,812 S 10/1999 Andrews, Jr. et al.
6,079,311 A 6/2000 O'Quinn et al.
6,374,718 B1 * 4/2002 Rescigno ..... F41A 21/30 89/14.4
6,796,214 B2 9/2004 Hausken et al.
7,073,426 B1 7/2006 White
7,237,467 B1 7/2007 Melton
7,412,917 B2 * 8/2008 Vais ..... F41A 21/30 181/223
7,587,969 B2 9/2009 Silvers
7,600,606 B2 * 10/2009 Brittingham ..... F41A 21/30 181/223
7,856,914 B2 12/2010 Shults et al.
7,931,118 B1 * 4/2011 Cronhelm ..... F41A 21/30 181/223
8,096,222 B2 * 1/2012 Silvers ..... F41A 21/34 181/223
8,104,570 B2 * 1/2012 Miller ..... F41A 21/30 181/223
8,162,100 B2 * 4/2012 Shults ..... F41A 21/30 181/223
8,292,025 B1 * 10/2012 Woodell ..... F41A 21/30 181/223
8,307,946 B1 * 11/2012 Johnston ..... F41A 21/30 181/223
8,424,635 B1 * 4/2013 Klawunn ..... F41A 21/34 181/223
8,479,632 B2 7/2013 Kline et al.
8,505,431 B2 * 8/2013 Hines ..... F41A 21/30 181/223
8,522,662 B2 9/2013 Press, Jr. et al.
8,528,691 B1 * 9/2013 Carmichael ..... F41A 21/30 181/223
8,739,922 B2 7/2014 Wirth et al.
8,807,005 B2 * 8/2014 Moss ..... F41A 21/24 181/223
8,826,793 B2 * 9/2014 Oliver ..... F41A 21/30 181/223
8,875,612 B1 * 11/2014 Klett ..... F41A 21/30 89/14.4
8,939,057 B1 1/2015 Edsall
8,950,310 B2 * 2/2015 Storrs ..... F41A 21/30 181/223
8,978,818 B2 * 3/2015 Proske ..... F41A 21/30 181/223
9,038,770 B1 * 5/2015 Morrison ..... F41A 21/30 181/223
9,038,771 B1 * 5/2015 Mueller ..... F41A 21/30 181/223
9,086,248 B2 * 7/2015 Young ..... F41A 21/30
9,207,033 B2 12/2015 Vais
9,395,136 B1 * 7/2016 Kovalov ..... F41A 21/30
9,400,151 B1 7/2016 Edsall
9,410,761 B2 8/2016 Morris et al.
9,482,484 B2 11/2016 Barney
9,506,710 B2 11/2016 Smith
9,599,421 B1 * 3/2017 Dean ..... F41A 21/30
9,658,018 B1 * 5/2017 Heckert ..... F41A 21/30
9,677,839 B1 * 6/2017 Phoenix ..... F41A 21/30
9,739,559 B2 * 8/2017 Bush ..... F41A 21/30
9,835,399 B1 * 12/2017 Lessard ..... F41A 21/30
9,851,166 B2 * 12/2017 Petersen ..... F41A 21/30
10,077,962 B1 * 9/2018 Dean ..... F41A 21/30
2012/0255807 A1 * 10/2012 Pieratti ..... F41A 21/30 181/223
2014/0157640 A1 * 6/2014 Whelan ..... F41C 23/16 42/75.02
2016/0018177 A1 1/2016 Powell
2016/0187093 A1 6/2016 Barrett
2016/0238335 A1 * 8/2016 Bertschinger ..... F41A 21/30
2018/0224235 A1 * 8/2018 Couvillion ..... F41A 21/30
2018/0306543 A1 * 10/2018 Tertin ..... F41A 21/325

* cited by examiner

FIREARM SUPPRESSOR

BACKGROUND

Firearms can produce undesirable levels of acoustic noise during use. When using a firearm, for example, it can be desirable to reduce acoustic noise levels because the sound produced by firing the firearm can provide information as to the location of a firearm operator and/or can damage or impair the hearing of the operator or bystanders. To reduce acoustic noise levels, sound reducing devices such as sound suppressors, mufflers, and the like are commonly used. Suppressors typically operate through diverting gases and energy into chambers surrounding a bore line of the device. A wide variety of chamber designs and baffles have been used to redirect gases. Common suppressor baffles include a series of forward expanding frustoconical shapes which divert a portion of gases away from the bore line. Despite improvements and refinements in suppressor designs, numerous problems remain which reduce performance of the suppressors and accompanying firearms. For example, most suppressors result in a reduced muzzle velocity, changed point of projectile impact, substantial weight increase, and other factors which limit their desirability in certain applications.

SUMMARY

Thus, there is a need for a firearm suppressor capable of reducing acoustic noise levels produced by a firearm while having a minimal effect on a speed and/or trajectory of a projectile. Accordingly, a firearm suppressor and associated systems are provided which provides improved performance. Such a firearm suppressor can comprise an outer shell, and a suppressor core disposed inside the outer shell. The suppressor core can have a projectile passageway for a projectile from a firearm to travel through. The projectile passageway can extend along a longitudinal axis or boreline. The suppressor core can also include a central support rib disposed along the longitudinal axis. In addition, the suppressor core can include a first baffle and a second baffle spaced apart along the longitudinal axis and supported by the central support rib. The first and second baffles can be oriented at different angles from one another. The first and second baffles and the central support rib can at least partially define the projectile passageway. The first and second baffles and the central support rib can also at least partially form two different sized expansion chambers on opposite sides of the central support rib in fluid communication with the projectile passageway to receive discharge gases associated with the projectile.

Furthermore, a firearm suppressor core in accordance with the principles herein can comprise a projectile passageway for a projectile from a firearm to travel through. The projectile passageway can extend along a longitudinal axis. The firearm suppressor core can also comprise a central support rib disposed along the longitudinal axis. Additionally, the firearm suppressor core can comprise a first baffle and a second baffle spaced apart along the longitudinal axis and supported by the central support rib. The first and second baffles can be oriented at different angles from one another. The first and second baffles and the central support rib can at least partially define the projectile passageway. The first and second baffles and the central support rib can also at least partially form two different sized expansion chambers on opposite sides of the central support rib in fluid communication with the projectile passageway to receive discharge gases associated with the projectile.

Figure 1:
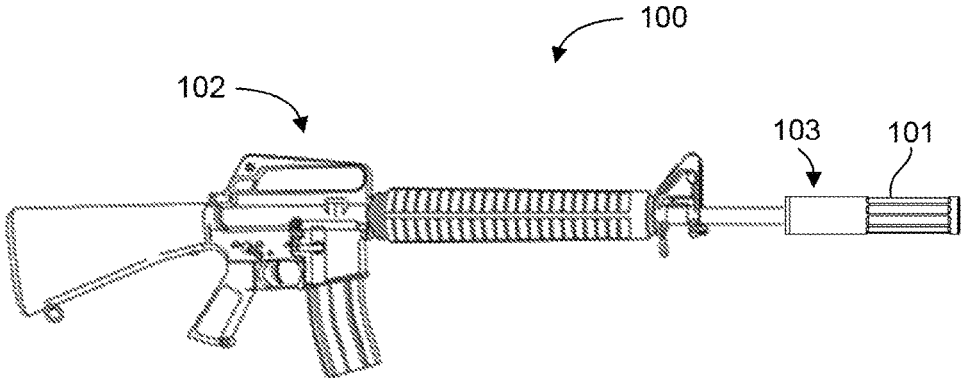
FIG. 1 illustrates a firearm suppressor system including a firearm suppressor mounted on a corresponding firearm, in accordance with an example of the present disclosure.

These figures are provided merely for convenience in describing specific embodiments of the invention. Alteration in dimension, materials, and the like, including substitution, elimination, or addition of components can also be made consistent with the following description and associated claims. Reference will now be made to the exemplary embodiments illustrated, and specific language will be used herein to describe the same. It will nevertheless be understood that no limitation of the scope of the invention is thereby intended.

DETAILED DESCRIPTION

Reference will now be made to certain examples, and specific language will be used herein to describe the same. Examples discussed herein set forth firearm suppressor and associated systems that can reduce acoustic noise levels produced by a firearm while having a minimal effect on a speed and/or trajectory of a bullet or projectile.

With the general embodiments set forth above, it is noted that when describing a firearm suppressor, or the related method, each of these descriptions are considered applicable to the other, whether or not they are explicitly discussed in the context of that embodiment. For example, in discussing the firearm suppressor per se, the system and/or method embodiments are also included in such discussions, and vice versa.

It is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "a chamber" includes one or more of such outer chambers and reference to "a baffle" includes one or more of such baffles.

Also, it is noted that various modifications and combinations can be derived from the present disclosure and illustrations, and as such, the following figures should not be considered limiting.

In describing and claiming the present invention, the following terminology will be used in accordance with the definitions set forth below.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims unless otherwise stated. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Illustrated in FIG. 1 is a firearm suppressor system 100. In accordance with one example of the present disclosure, the firearm suppressor system 100 can comprise a firearm 102 and a firearm suppressor 101 coupled to a muzzle end 103 of the firearm, from which a projectile, such as a bullet, and discharge gases exit the firearm upon firing. As described herein, the firearm suppressor 101 can at least temporarily trap discharge gases from the firing of a projectile and divert away from the projectile's path to reduce or prevent alteration of a trajectory or a speed of the projectile by the discharge gases.

Figure 2A:
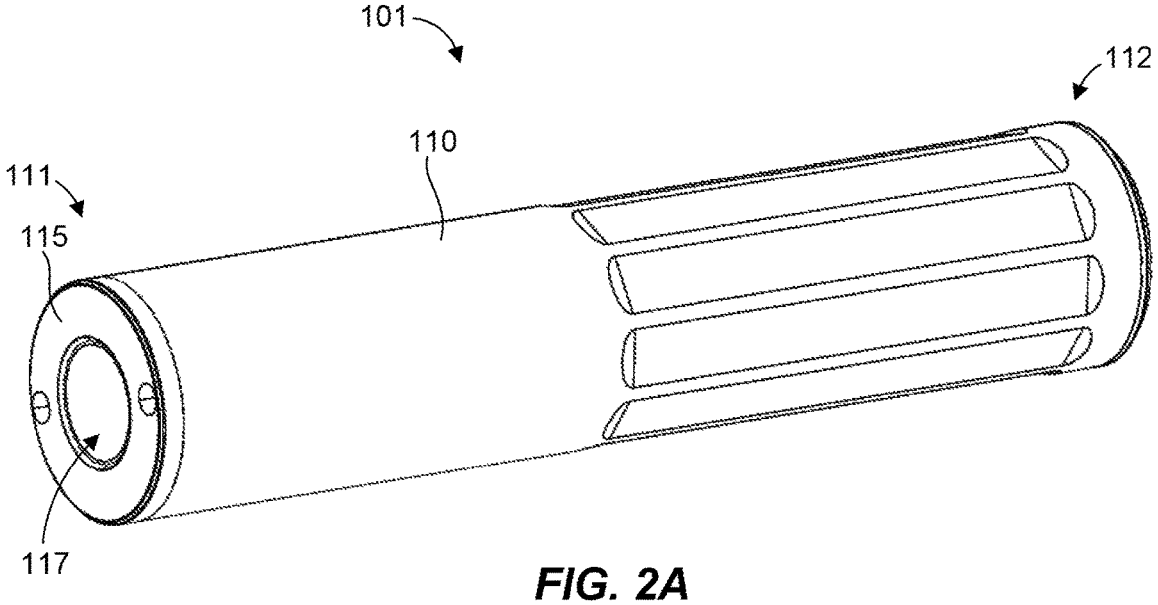
FIGS. 2A and 2B are perspective views of the firearm suppressor of FIG. 1.
Figure 2B:
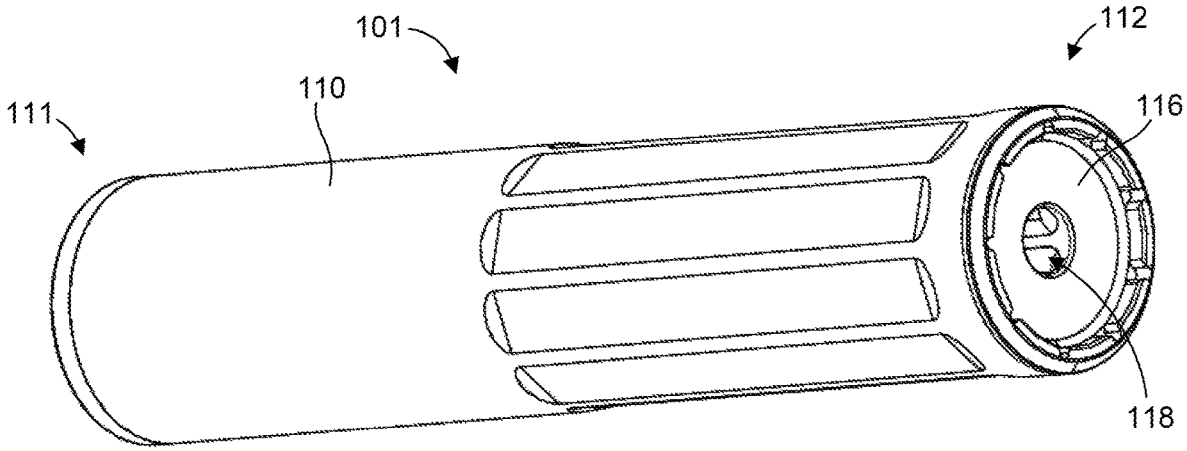
Figure 3:
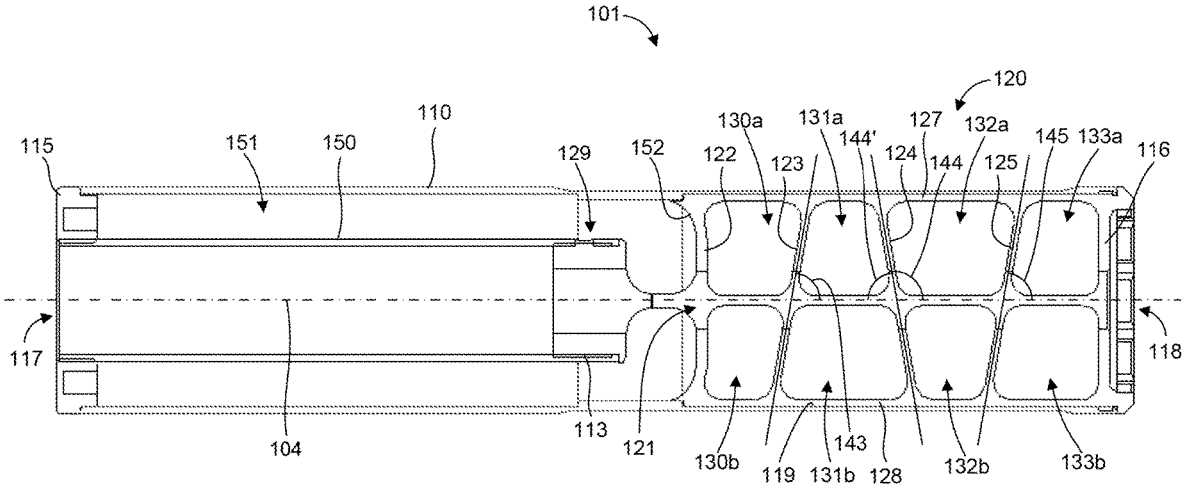
FIG. 3 is a side cross-sectional view of the firearm suppressor of FIG. 1.
Figure 4:
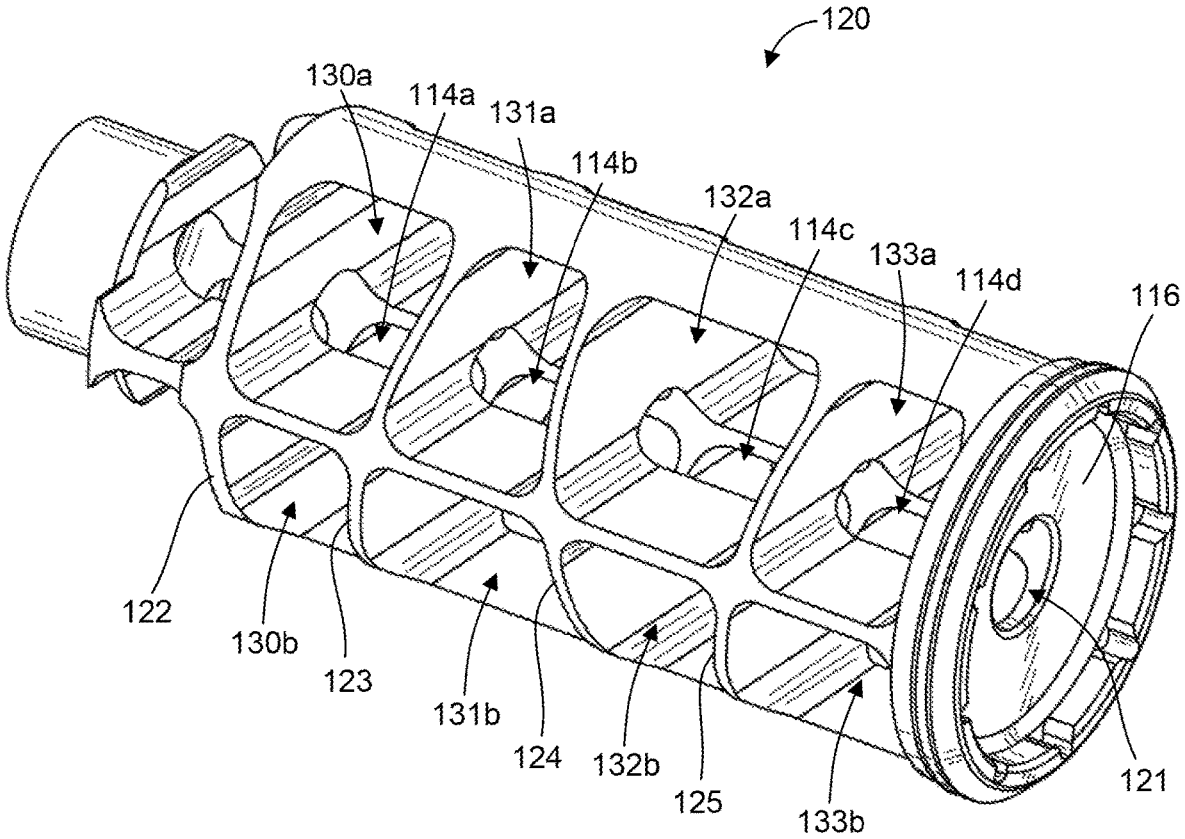
FIG. 4 is a perspective view of a suppressor core of the firearm suppressor of FIG. 1.
Figure 5A:
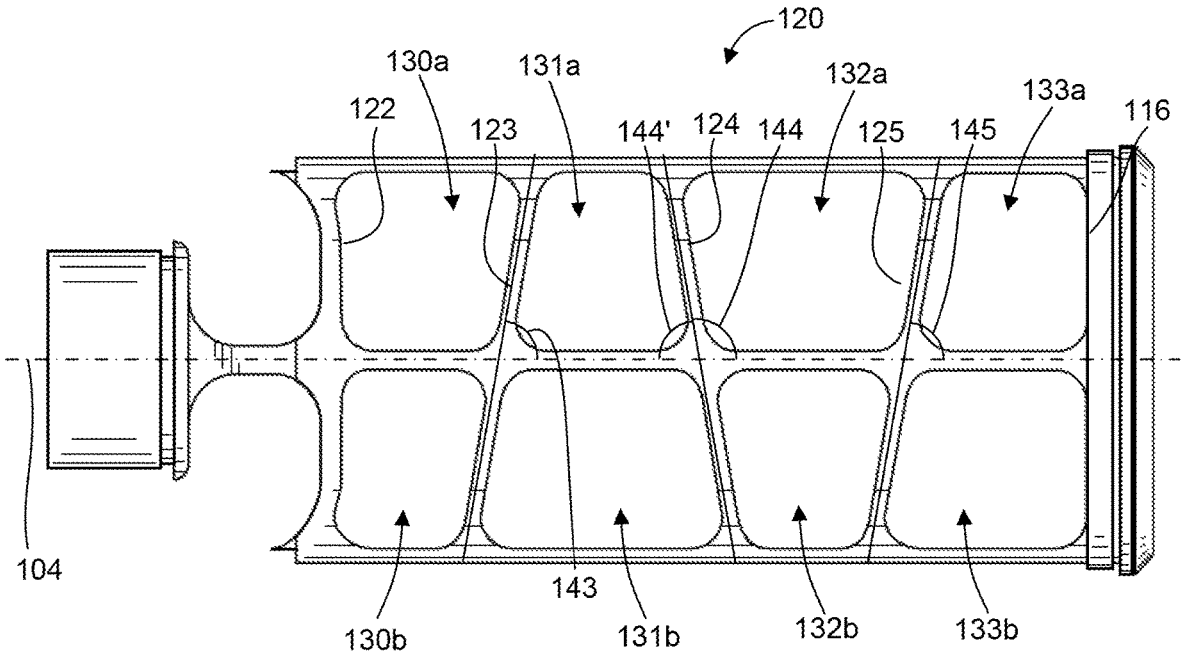
FIG. 5A is a left side view of the suppressor core of FIG. 4.
Figure 5B:
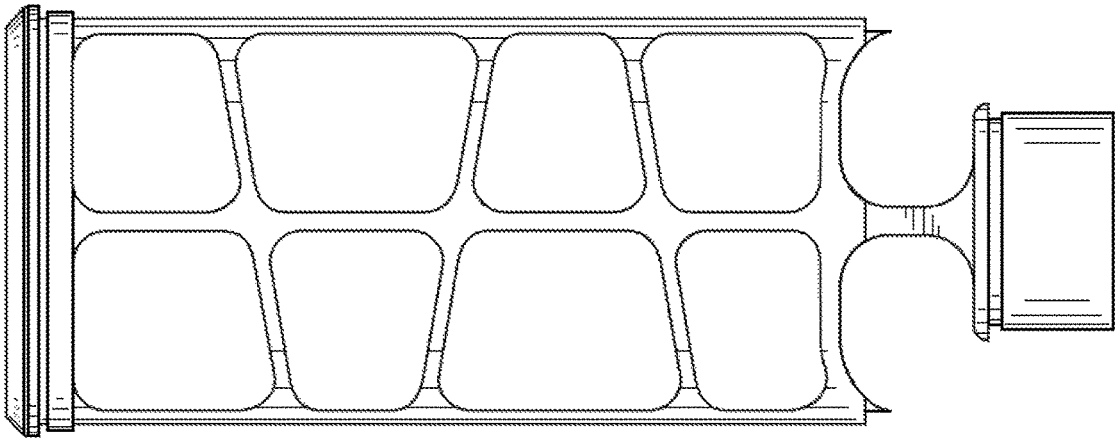
FIG. 5B is a right side view of the suppressor core of FIG. 4.
Figure 5C:
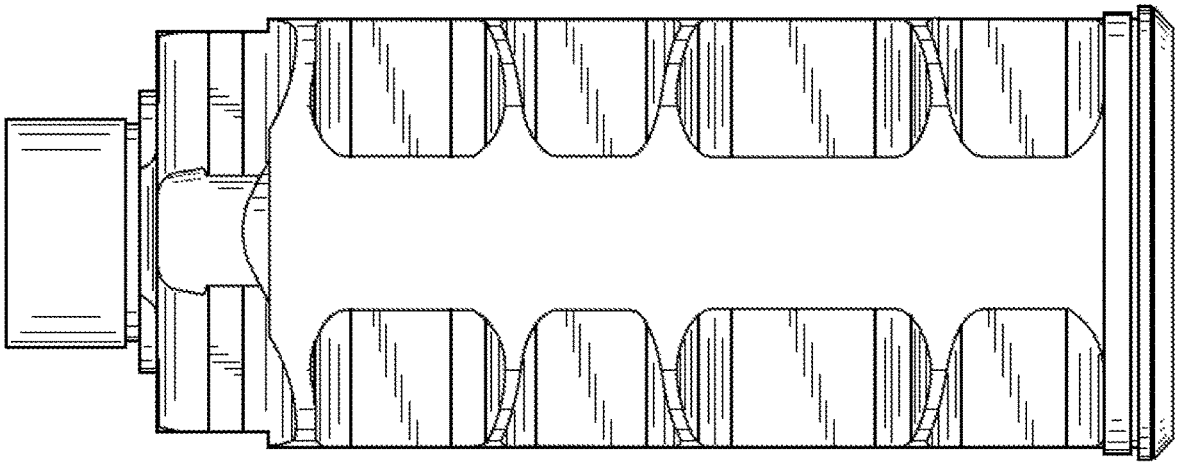
FIG. 5C is a top view of the suppressor core of FIG. 4.
Figure 5D:
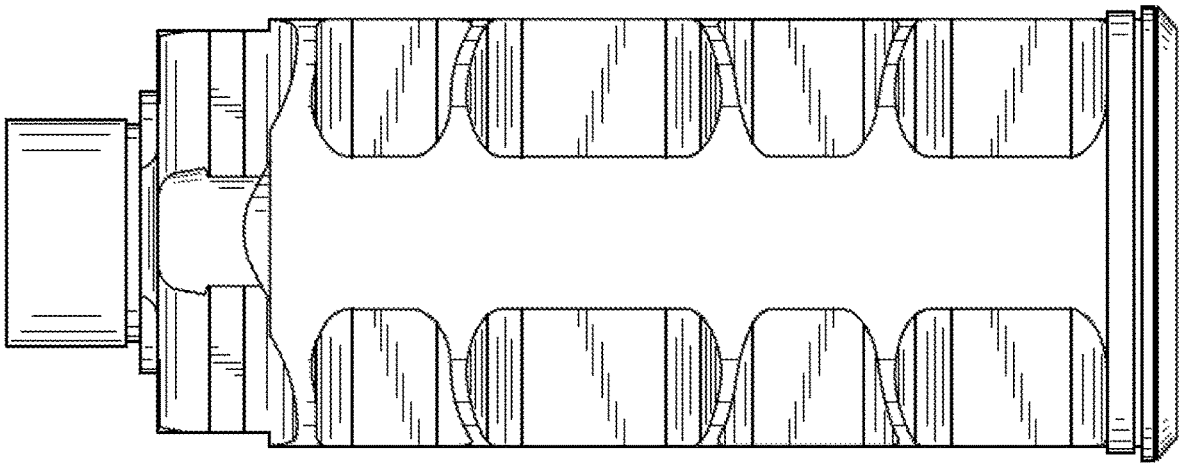
FIG. 5D is a bottom view of the suppressor core of FIG. 4.
Figure 5E:
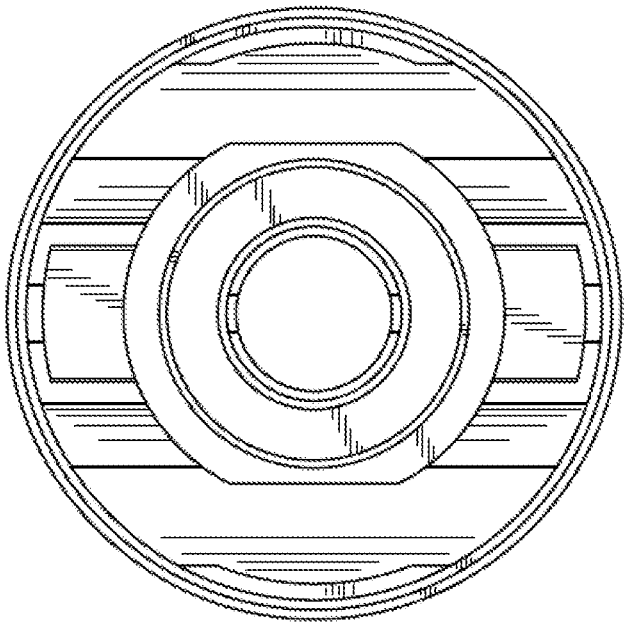
FIG. 5E is a back (attachment) end view of the suppressor core of FIG. 4.
Figure 5F:
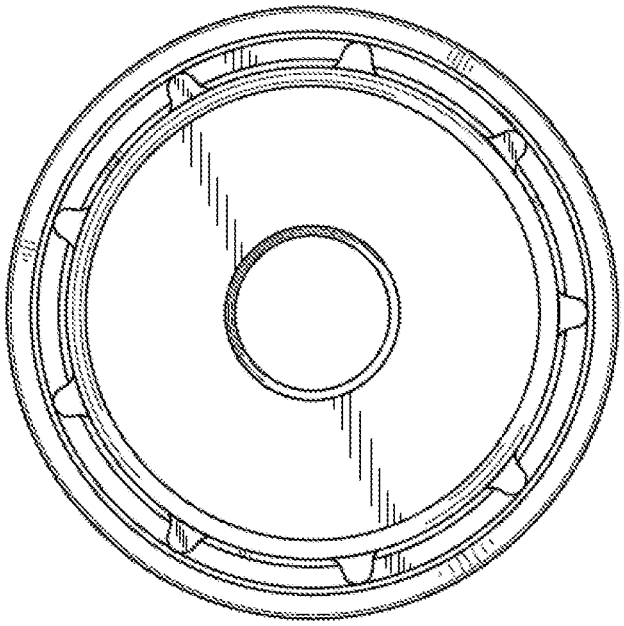
FIG. 5F is a front (discharge) end view of the suppressor core of FIG. 4.

With continued reference to FIG. 1, FIGS. 2A-3 illustrate the firearm suppressor 101 separate from the firearm 102. FIGS. 2A and 2B show perspective views of the firearm suppressor 101 and FIG. 3 illustrates a side cross-sectional view of the firearm suppressor 101. The firearm suppressor 101 can include an outer shell 110 and a suppressor core or insert 120 (FIG. 3) disposed within the outer shell 110. An entrance end 111 of the firearm suppressor 101 can receive the muzzle end 103 of the firearm 102 and a projectile can exit the firearm suppressor 101 via an exit end 112 opposite the entrance end 111. The firearm suppressor 101 can include a coupling feature 113 (FIG. 3) adapted to couple with a mating coupling feature of the firearm 102. The coupling feature can be any mechanism which secures the suppressor to the muzzle end of the firearm in longitudinal alignment. The coupling feature can be a threaded coupling although other coupling mechanisms can also be used such as, but not limited to, locking detents, channel-groove interface, cam and groove couplings, and the like. End caps 115, 116 can secure internal components (e.g., the suppressor core 120) within the outer shell 110. The end caps 115, 116 and the outer shell 110 can include any suitable coupling feature, such as threaded interfaces, to facilitate removably coupling the end caps 115, 116 and the outer shell 110. In some embodiments, the end caps 115, 116 can be permanently attached to the outer shell 110, such as via a weld. The end cap 115 can have an aperture or opening 117 configured to receive the muzzle end 103 of the firearm 102 to facilitate coupling the firearm suppressor 101 to the firearm 102. The end cap 116 can have an aperture or opening 118 configured to allow the projectile to pass through upon exiting the firearm suppressor 101.

With continued reference to FIGS. 1-3, FIG. 4 illustrates a perspective of a suppressor core 120 in accordance with an example of the present disclosure, which can be disposed in the outer shell 110 of the firearm suppressor 101. Various other views of the suppressor core 120 are shown in FIGS. 5A-5F. The outer shell 110 can be sized to receive the suppressor core 120 such that an inner surface 119 of the outer shell 110 can be in contact with the suppressor core 120. The suppressor core 120 can be adapted to be a permanent fixture within the outer shell 110 or exchangeable for another suppressor core to accommodate a range of firearm calibers and allow for cleaning of the suppressor core. For example, the suppressor core 120 can be adapted to accommodate a range of firearm calibers (e.g. 5.56 mm, 6.8 mm, 7.62 mm, 5.45 mm, and the like). Thus, the suppressor core 120 can be used as an exchangeable component of the firearm suppressor 101 or as a permanent fixture of the firearm suppressor 101. The end cap 116 is shown associated with the suppressor core 120. The end cap 116 and the suppressor core 120 can be separate components or integrally formed as a monolithic (i.e., single unitary) component.

In one aspect, the entire suppressor core 120 can comprise a monolithic (i.e., single unitary) component, such as a single component manufactured from a single piece of stock material, which can increase longevity and reliability of the suppressor core 120. It should be recognized, however, that the suppressor core 120 can be constructed in any suitable manner and can include any number of individual components or elements. The suppressor core 120 can be made from any suitable material, such as carbon fiber, aluminum, titanium, steel, stainless steel, and the like. High temperature metal alloys such as, but not limited to, STELLITE, INCONEL, KOVAR, MONEL, and other high temperature alloys, or high nickel alloys can also be suitable.

The suppressor core 120 can include a projectile passageway 121 for a projectile from the firearm 102 to travel through. The projectile passageway 121 can extend along a longitudinal axis 104 of the firearm suppressor 101. The suppressor core 120 can also include baffles 122-125 spaced apart along the longitudinal axis 104. In addition, the suppressor core 120 can include a central support rib 126 disposed along the longitudinal axis 104. The baffles 122-125 can be supported by the central support rib 126. The baffles 122-125 and the central support rib 126 can at least partially define the projectile passageway 121. The suppressor core 120 can also include outer support ribs 127, 128 on opposite sides of the central support rib 126 coupled to radially outermost portions of the baffles 122-125.

In one aspect, the projectile passageway 121 can comprise a cylindrical configuration. In some embodiments, the cylindrical configuration can comprise a circular cross section, although any suitable cross-section can be incorporated. The projectile passageway 121 can exhibit a constant diameter along the longitudinal axis 104 of the firearm suppressor 101. The size of the projectile passageway 121 can be sized sufficiently large enough and free of obstructions so that a projectile may travel without impediment through the suppressor core 120. The size of the projectile passageway 121 can vary depending on the caliber of the firearm 102. For example, the larger the caliber of the firearm 102, the larger the projectile passageway 121. As a general guideline, the inner diameter of the projectile passageway 121 can be from 10% to 30% larger than an outer diameter of the corresponding projectile.

The baffles 122-125, the central support rib 126, and the outer support ribs 127, 128 of the suppressor core 120 can at least partially form expansion chambers 130*a-b*, 131*a-b*, 132*a-b*, 133*a-b* isolated from one another, but in fluid communication with the projectile passageway 121 to receive discharge gases associated with the projectile. The baffles 122-125 can be solid partitions with apertures for the projectile passageway 121. The baffles 122-125 can form a forward boundary of one expansion chamber and can also form a rearward boundary of an adjacent expansion chamber. The expansion chambers 130*a-b*, 131*a-b*, 132*a-b*, 133*a-b* can be in fluid communication with the projectile passageway 121 via longitudinal openings 114*a-d* in the central support rib 126. It should be recognized that the suppressor core 120 can include any number of expansion chambers.

The outer shell 110 can also serve to form the expansion chambers 130*a-b*, 131*a-b*, 132*a-b*, 133*a-b*. The outer shell 110 (i.e. outer cylindrical casing) and the baffles 122-125 can be disposed and formed such that outer perimeters of the baffles 122-125 meet the inner surface 119 of the outer shell 110 to form outer peripheral boundaries of the expansion chambers 130*a-b*, 131*a-b*, 132*a-b*, 133*a-b*. For example, the baffles 122-125 can include curved periphery edge profiles that are configured to match the curvature of the inner surface 119 of the outer shell 110. The baffles 122-125 can contact the outer shell 110 so that discharge gasses can only flow through the projectile passageway 121 to move through the suppressor core 120.

The expansion chambers 130*a*, 131*a*, 132*a*, and 133*a* are on opposite sides of the central support rib 126 from the expansion chambers 130*b*, 131*b*, 132*b*, and 133*b*. The baffles 123-125 can be slanted or angled such that the expansion chambers opposite one another about the central support rib 126 have different sizes or asymmetry (i.e., in reflection) about the central support rib 126. For example, the baffles 123, 124 forming chambers 131*a*, 131*b* can be oriented at different angles 143, 144 relative to the longitudinal axis 104 from one another. For example, the angle 143 can be less than 90 degrees and the angle 144 can be greater than 90 degrees. As a general rule, the angle 143 can range from about 60° to 88°, and most often from 75 to 85°. Supplementary angle 144 can thus range from 120° to 92°, and most often from 105 to 95°. In one aspect, the baffles 123, 124 can be oppositely oriented relative to the longitudinal axis 104. For example, a supplementary angle 144' to angle 144 can be equal to the angle 143, but oriented opposite the angle 143 relative to the longitudinal axis 104. Radially outermost ends of the baffles 122-125 can be spaced from each other. The result is a relatively smaller trapezoidal shaped chamber 131*a* and a relatively larger trapezoidal shaped chamber 131*b* radially opposite one another as a differential trapezoidal chamber pair.

In addition, the baffle 125 can be oriented at an angle 145 relative to the longitudinal axis 104. In some embodiments, the angles 143, 145 can be equal, thus orienting the baffles 123, 125 at the same angle. The slant or angle direction of the baffles 123-125 can alternate sequentially along the longitudinal axis 104. As a result, not only can the size of expansion chambers opposite one another about the central support rib 126 differ, but the sizes of the expansion chambers 131*a*, 132*a*, 133*a* and the expansion chambers 131*b*, 132*b*, 133*b* on a same side of the central support rib 126 can alternate between relatively small and large along the longitudinal axis 104. Alternating chamber slant angles along a longitudinal direction allows for a substantially reduced resonant affect as projectiles pass along the suppressor. Accordingly, the projectile speed and trajectory (e.g. yaw) with respect to the longitudinal axis can be stabilized and adverse effects can be reduced.

In one aspect, the expansion chambers 130*a-b*, 131*a-b*, 132*a-b*, 133*a-b* are fluidly isolated from one another, except via the openings 114*a-d* of each expansion chamber in the central support rib 126 that fluidly couple the expansion chambers to the projectile passageway 121. Thus, discharge gases that enter the expansion chambers can be trapped, at least temporarily, in the expansion chambers, only exiting the expansion chambers through the openings in which the gases entered each expansion chamber. One benefit of this configuration can be little or no alteration of a trajectory or a speed of the projectile by the discharge gases, which can be diverted away from the projectile by the baffle structures described herein. In addition, the differently sized or asymmetric expansion chamber pairs isolated by, and opposite one another about, the central support rib 126 can slow down and cool the discharge gas flow as well as minimize or cancel out resonance, which can reduce the noise of gun shots. Discharge gases from conventional prior art suppressors often causes resonance, which can alter the bullet's speed and trajectory as well as negatively impact sound suppression. The asymmetric expansion chamber pairs of the present invention can substantially reduce such negative resonant effects. The central support rib 126 not only isolates expansion chambers, but can also be configured to provide increased strength and structural integrity for the suppressor core 120, which can enable other features (e.g., baffles and walls) to be thinner thereby increasing expansion chamber size and/or reducing weight and improving reliability.

As shown in FIG. 3, the firearm suppressor 101 can include an over-barrel sleeve 150 configured to fit radially outward of a barrel of the firearm 102. The over-barrel sleeve 150 can at least partially form or define, along with the outer shell 110, an over-barrel expansion chamber 151. In one aspect, the baffle 122 can be configured to direct a portion of the discharge gasses rearward into the over-barrel expansion chamber 151, such as with rearwardly curved or angled radially outward portions 152 adjacent and coupled to the outer ribs 127, 128. With its relatively large volume, the over-barrel expansion chamber 151 may serve as a primary expansion chamber. In some embodiments, the over-barrel expansion chamber 151 can include one or more baffles (not shown) to capture discharge gas in the chamber 151.

In one aspect, the suppressor core 120 can have an entrance portion 129 adapted to facilitate coupling (e.g., via the coupling feature 113) the suppressor core 120, and therefore the suppressor 101, to the firearm 102. The over-barrel sleeve 150 can be removably coupleable with the entrance portion 129 or integrally formed as a monolithic structure with the suppressor core 120. The over-barrel sleeve 150 can be configured such that a gap is maintained between the firearm barrel and the over-barrel sleeve 150. The over-barrel expansion chamber 151 can have substantial overlap with a muzzle and/or a barrel of the firearm 102 when coupled to the muzzle end of the firearm. Although the over-barrel expansion chamber 151 can extend over the barrel any length, lengths often run from 1 to 16 inches, and in some cases 4 to 9 inches.

The increased volume provided by the enlarged over-barrel expansion chamber 151, compared to that of a firearm suppressor with no over-barrel chamber, can accumulate and/or accommodate a higher volume of discharge gases to ensure that enough discharge gases are diverted away from and behind the projectile so that speed and/or trajectory of the projectile are not affected by the firearm suppressor and additional acoustic suppression can be obtained. Such a configuration may be beneficial for higher powered bullets, which typically produce more discharge gases than smaller, less powerful bullets. Although the illustrated firearm suppressor embodiment includes an over-barrel expansion chamber, it should be recognized that some embodiments of firearm suppressors may not include over-barrel expansion chambers. In such cases, the suppressor can include a rear end cap which is generally coplanar with the entrance portion 129 of the suppressor core 120 and which mates with the corresponding outer housing.

Figure 6:
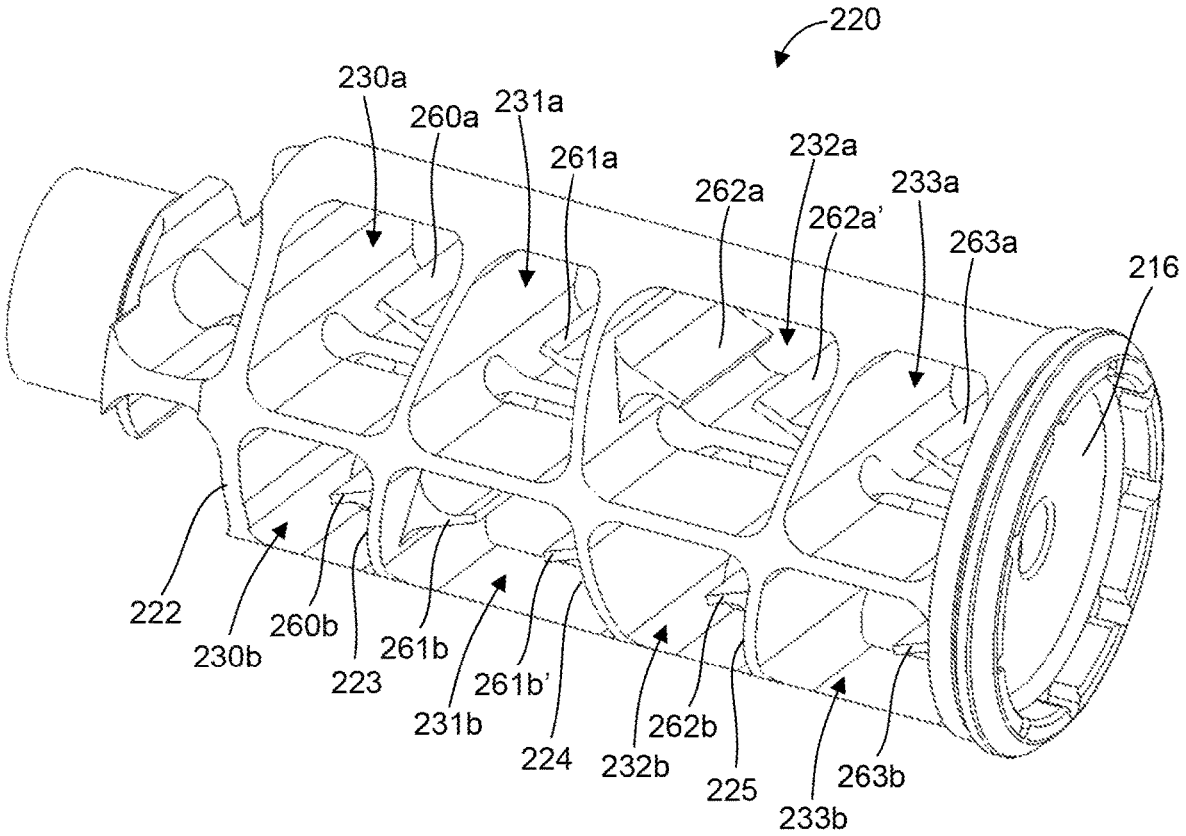
FIG. 6 is a perspective view of a suppressor core of a firearm suppressor in accordance with an example of the present disclosure.

FIG. 6 illustrates a perspective of a suppressor core 220 in accordance with an example of the present disclosure, which can be disposed in an outer shell of a firearm suppressor as disclosed herein. Various other views of the suppressor core 220 are shown in FIGS. 7A-7D, although primary reference is made to FIGS. 6 and 7A. The suppressor core 220 is similar in many respects to the suppressor core 120 discussed above. In this case, the suppressor core 220 includes secondary baffles 260*a*, 261*a*, 262*a*, 262*a*', 263*a*, 260*b*, 261*b*, 261*b*', 262*b*, 263*b* disposed in one or more expansion chambers 230*a-b*, 231*a-b*, 232*a-b*, 233*a-b*. The secondary baffles can be of any suitable size and can have any suitable configuration. In addition, any number of secondary baffles can be included in an expansion chamber. In some embodiments, the relative size and/or configuration of the secondary baffles and the expansion chambers can influence the number of secondary baffles in a given expansion chamber. For example, two secondary baffles 262*a*, 262*a*' and 261*b*, 261*b*' can be disposed in the respective expansion chambers 232*a*, 231*b*, which are relatively large compared to the smaller expansion chambers 232*b*, 231*a*. One (e.g., only a single) secondary baffle 261*a*, 262*b* can be disposed in the smaller expansion chambers 231*a*, 232*b*, respectively. In addition, one (e.g., only a single) secondary baffle 260*a*, 263*a*, 260*b*, 263*b* can be disposed in respective expansion chambers 230*a*, 233*a*, 230*b*, 233*b*.

In one aspect, the secondary baffles can be supported by baffles 223-225. For example, the secondary baffles 262*a*, 262*a*' disposed in larger expansion chamber 232*a* can be supported by both baffles 224, 224 forming the expansion chamber 232*a*, and the secondary baffles 261*b*, 261*b*' disposed in larger expansion chamber 231*b* can be supported by both baffles 223, 224 forming the expansion chamber 231*b*. The secondary baffles 260*a*, 261*a*, 260*b*, 262*b* disposed in the smaller expansion chambers 230*a*, 231*a*, 230*b*, 232*b* can be supported by the baffle 223, 224, 223, 225 forming the respective expansion chambers 230*a*, 231*a*, 230*b*, 232*b* that is located toward the exit or distal end of the suppressor. Thus, the secondary baffles 260*a*, 261*a*, 260*b*, 262*b* disposed in the smaller expansion chambers 230*a*, 231*a*, 230*b*, 232*b* can extend opposite a direction of travel of the projectile. In some embodiments, secondary baffles 263*a-b* can be supported by and extending from an end cap 216. In addition, the secondary baffles can include curved transition surfaces to blend or smooth a transition between the secondary baffles and the supporting baffles and/or end cap.

The secondary baffles 260*a*, 261*a*, 262*a*, 262*a*', 263*a*, 260*b*, 261*b*, 261*b*', 262*b*, 263*b* can each be oriented at an angle 246, 247 relative to a longitudinal axis 204 of the firearm suppressor. The angles 246, 247 can range from about 20° to 45°, and most often from 25° to 35°. Oppositely extending secondary baffles be oriented at the same or different angles 246, 247 within each chamber. For example, in the illustrated embodiment, the secondary baffles 261*a*, 262*a* extend in generally opposite directions within each chamber. The angles 246, 247 are equal and therefore the secondary baffles 261*a*, 262*a* can be parallel to one another.

In one aspect, the secondary baffles 260*a*, 261*a*, 262*a*, 262*a*', 263*a*, 260*b*, 261*b*, 261*b*', 262*b*, 263*b* may be laterally spaced or separated from an outer shell (not shown) disposed about the suppressor core 220. For example, as shown in FIG. 6, the secondary baffles may not extend to an outer periphery of the suppressor core. In other words, the secondary baffles are not laterally coextensive with the baffles 222-225 and/or end cap 216 such that lateral spaces or gaps are present in the expansion chambers between side walls of the secondary baffles and lateral sides of the expansion chambers formed by an outer shell.

Figure 7A:
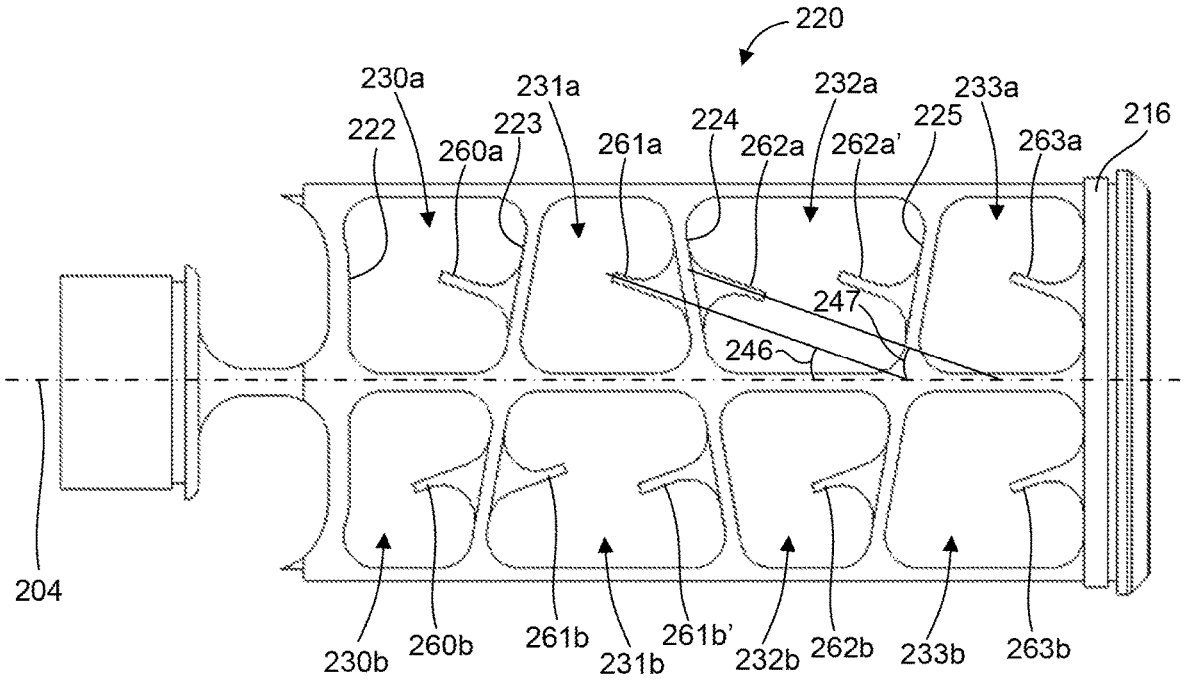
FIG. 7A is a left side view of the suppressor core of FIG. 6.
Figure 7B:
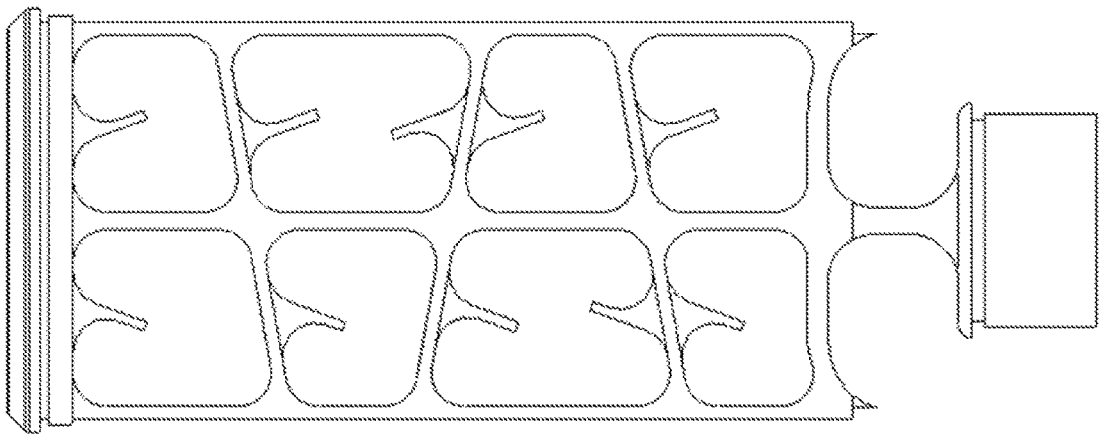
FIG. 7B is a right side view of the suppressor core of FIG. 6.
Figure 7C:
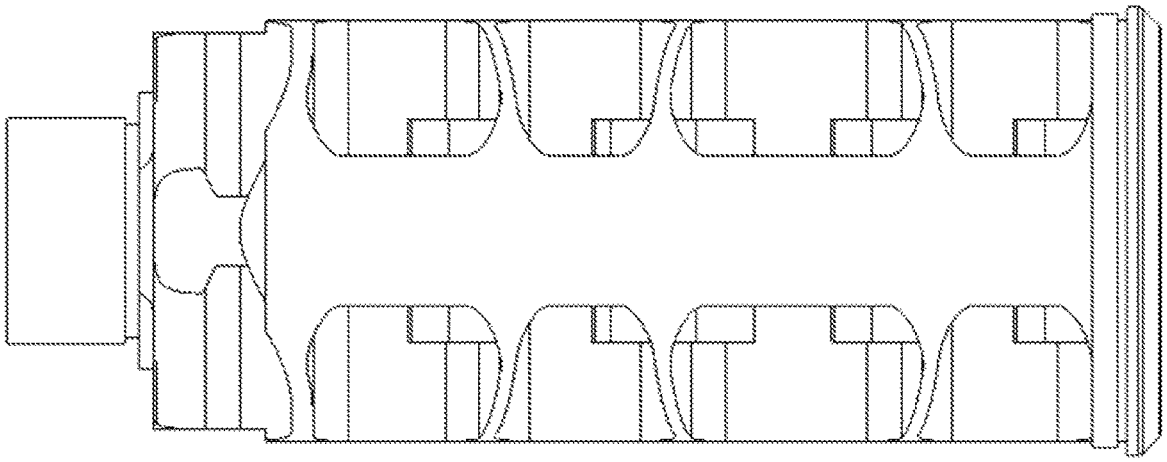
FIG. 7C is a top view of the suppressor core of FIG. 6.
Figure 7D:
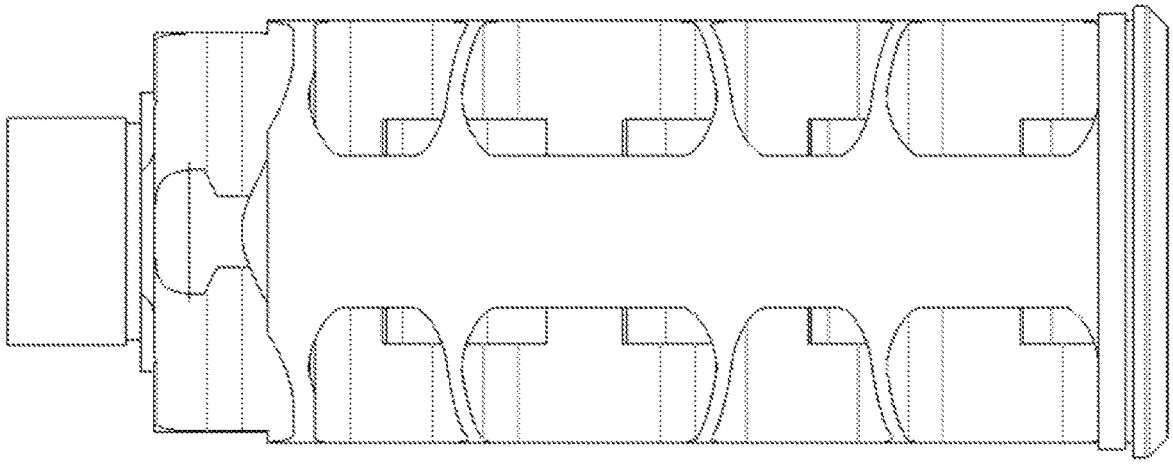
FIG. 7D is a bottom view of the suppressor core of FIG. 6.
Figure 7E:
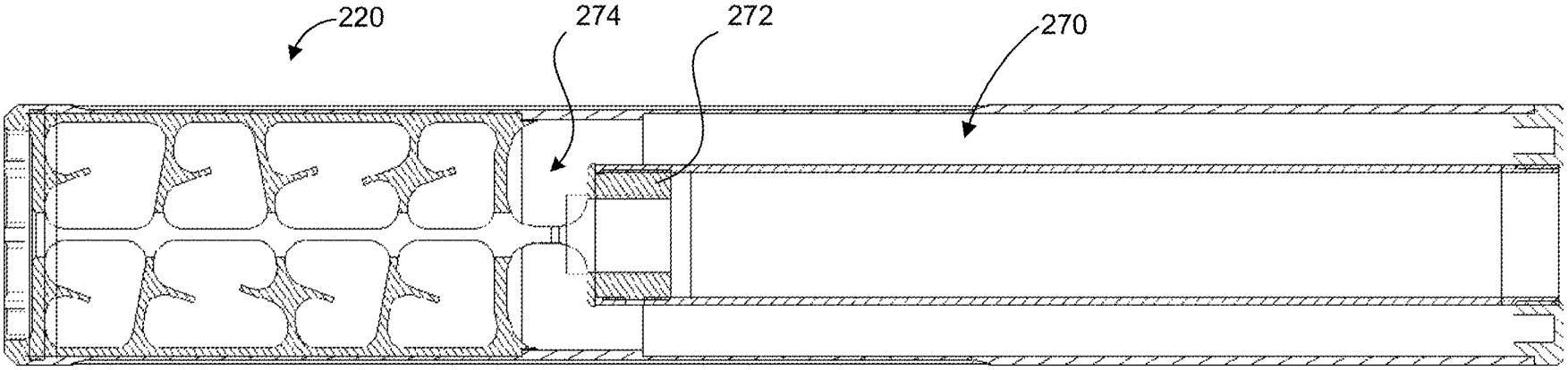
FIG. 7E is a cross-sectional view of the suppressor core of FIG. 6 including an over-barrel expansion chamber in accordance with another example of the present disclosure.

FIG. 7E shows a cross-sectional view of the suppressor core 220 having an over-barrel expansion chamber 270 similar to the configuration outlined with respect to FIG. 3. More specifically, the over-barrel expansion chamber 270 can extend rearwardly and radially about the barrel of the firearm. The suppressor core 220 can be mounted to a muzzle end of a firearm via a complimentary muzzle coupling 272. As such, the over-barrel expansion chamber can be suspended about the barrel without contacting outer surfaces of the barrel. Gases following a projectile can first enter the over-barrel expansion chamber 270 via a preliminary expansion region 274 adjacent the boreline. This region is shaped to direct gases rearward into the over-barrel expansion chamber 270.

It is to be understood that the above-referenced embodiments are illustrative of the application for the principles of the present invention. Numerous modifications and alternative arrangements can be devised without departing from the spirit and scope of the present invention while the present invention has been shown in the drawings and described above in connection with the exemplary embodiment(s) of the invention. It will be apparent to those of ordinary skill in the art that numerous modifications can be made without departing from the principles and concepts of the invention as set forth in the claims.

What is claimed is:

1. A firearm suppressor, comprising:

an outer shell; and a suppressor core disposed inside the outer shell, the suppressor core having a projectile passageway for a projectile from a firearm to travel through, the projectile passageway extending along a longitudinal axis;

a central support rib disposed along the longitudinal axis and defining a rib plane that intersects the longitudinal axis, the central support rib extending in the rib plane from an entrance portion to an exit end of the firearm suppressor core;

a first baffle and a second baffle spaced apart along the longitudinal axis and supported by the central support rib, the first and second baffles being oriented at different angles from one another; and one or more secondary baffles supported by at least one of the first and second baffles, at least one of the one or more secondary baffles being oriented at an angle from 20 to 45 degrees relative to the longitudinal axis, wherein the first and second baffles and the central support rib at least partially define the projectile passageway, and at least partially form two different sized expansion chambers on opposite sides of the central support rib in fluid communication with the projectile passageway to receive discharge gases associated with the projectile.

2. The firearm suppressor of claim 1, wherein the expansion chambers are partially formed by the outer shell.

3. The firearm suppressor of claim 1, further comprising an over-barrel sleeve coupled to the entrance portion and configured to fit radially outward of a barrel of the firearm and at least partially form an over-barrel expansion chamber, wherein the entrance portion is adapted to facilitate coupling the firearm suppressor core to a muzzle end of the firearm.

4. The firearm suppressor of claim 3, wherein the over-barrel expansion chamber is partially formed by the outer shell.

5. The firearm suppressor of claim 3, further comprising a third baffle supported by the central support rib and configured to direct a portion of the discharge gases rearward into the over-barrel expansion chamber.

6. The firearm suppressor of claim 1, wherein the first and second baffles are oppositely oriented relative to the longitudinal axis.

7. The firearm suppressor of claim 6, wherein the first and second baffles are oriented at opposite but substantially equal angles relative to the longitudinal axis.

8. The firearm suppressor of claim 1, wherein the suppressor core further comprises a third baffle spaced apart from the second baffle such that the second baffle is between the first and third baffles.

9. The firearm suppressor of claim 8, wherein the first and third baffles are oriented at substantially the same angle.

10. The firearm suppressor of claim 9, wherein the first and second baffles are oriented at opposite but substantially equal angles relative to the longitudinal axis.

11. The firearm suppressor of claim 10, wherein the different angles are 60 to 88 degrees and 92 to 120 degrees, respectively.

12. The firearm suppressor of claim 1, wherein at least one of the one or more secondary baffles is disposed in at least one of the expansion chambers.

13. The firearm suppressor of claim 12, wherein two of the one or more secondary baffles are disposed in a larger of the expansion chambers.

14. The firearm suppressor of claim 13, wherein the two of the one or more secondary baffles disposed in the larger of the expansion chambers are supported by the first and second baffles.

15. The firearm suppressor of claim 12, wherein one of the one or more secondary baffles is disposed in a smaller of the expansion chambers.

16. The firearm suppressor of claim 15, wherein the one of the one or more secondary baffles disposed in the smaller of the expansion chambers extends opposite a direction of travel of the projectile.

17. The firearm suppressor of claim 12, wherein only one of the one or more secondary baffles is present in each of the at least one of the expansion chambers.

18. The firearm suppressor of claim 1, wherein at least one of the one or more secondary baffles is oriented at an angle less than or equal to 60 degrees relative to the longitudinal axis.

19. The firearm suppressor of claim 1, further comprising first and second outer support ribs on opposite sides of the central support rib coupled to radially outermost portions of the first and second baffles.

20. The firearm suppressor of claim 1, wherein the central support rib, the first baffle, and the second baffle are formed as a single unitary structure.

21. The firearm suppressor of claim 1, wherein the entrance portion is adapted to facilitate coupling the firearm suppressor core to a muzzle end of the firearm.

22. The firearm suppressor of claim 1, wherein the one or more secondary baffles have a laterally extended fin profile with a width dimension transverse to the longitudinal axis that is greater than a length dimension parallel to the longitudinal axis.

23. The firearm suppressor of claim 1, wherein the first and second baffles are planar.

24. The firearm suppressor of claim 1, wherein the longitudinal axis is radially centered within the suppressor core.

25. The firearm suppressor of claim 1, wherein the first and second baffles have a curved transition with expansion chamber walls.

* * * * *